United States Patent [19]

Kissich et al.

[11] 4,188,069

[45] Feb. 12, 1980

[54] MINING MACHINE HAVING WALK-ON PLATFORM ON CUTTER ARM

[75] Inventors: Arnulf Kissich; Florian Süssenbacher, both of Zeltweg, Austria

[73] Assignee: Vereinigte Osterreichische Eisen- und Stahlwerke - Alpine Montan Aktiengesellschaft, Vienna, Austria

[21] Appl. No.: 895,503

[22] Filed: Apr. 11, 1978

[30] Foreign Application Priority Data

Apr. 28, 1977 [AT] Austria ..... 3028/77

[51] Int. Cl.[2] ..... E21C 35/00

[52] U.S. Cl. ..... 299/73; 175/219; 182/131

[58] Field of Search ..... 299/12, 64, 73–76; 182/130, 131; 175/219

[56] References Cited

U.S. PATENT DOCUMENTS

| | | | |
|---|---|---|---|
| 2,614,807 | 10/1952 | Curtis | 182/131 X |
| 3,191,717 | 6/1965 | Hiyama | 182/131 |
| 4,088,371 | 5/1978 | LeBegue et al. | 299/76 |

FOREIGN PATENT DOCUMENTS

| | | | |
|---|---|---|---|
| 553850 | 1/1957 | Belgium | 299/76 |

*Primary Examiner*—Ernest R. Purser

*Attorney, Agent, or Firm*—Cushman, Darby & Cushman

[57] ABSTRACT

In a cutting machine having a cutter arm which is mounted at one end for universal pivotal movement and which carries at its free end a cutting tool: a walk-on platform covering at least part of the cutter arm, said platform being box-shaped in cross-section and having a width greater than the width of the cutter arm so as to protrude beyond the sides of the cutter arm and said platform having a generally planar top wall and a bottom wall which conforms to and rests on the exterior surface of the cutter arm; and at least one walk-on plate hinged to the platform at a side edge thereof for swinging movement about an axis which is approximately parallel to the axis of the cutter arm, said plate having a width less than the width of the upper wall of the platform movable from a position in which it lies on the top wall of the platform to an extended position in which it is approximately co-planar with the top wall of the platform.

4 Claims, 3 Drawing Figures

MINING MACHINE HAVING WALK-ON PLATFORM ON CUTTER ARM

Figure 1:
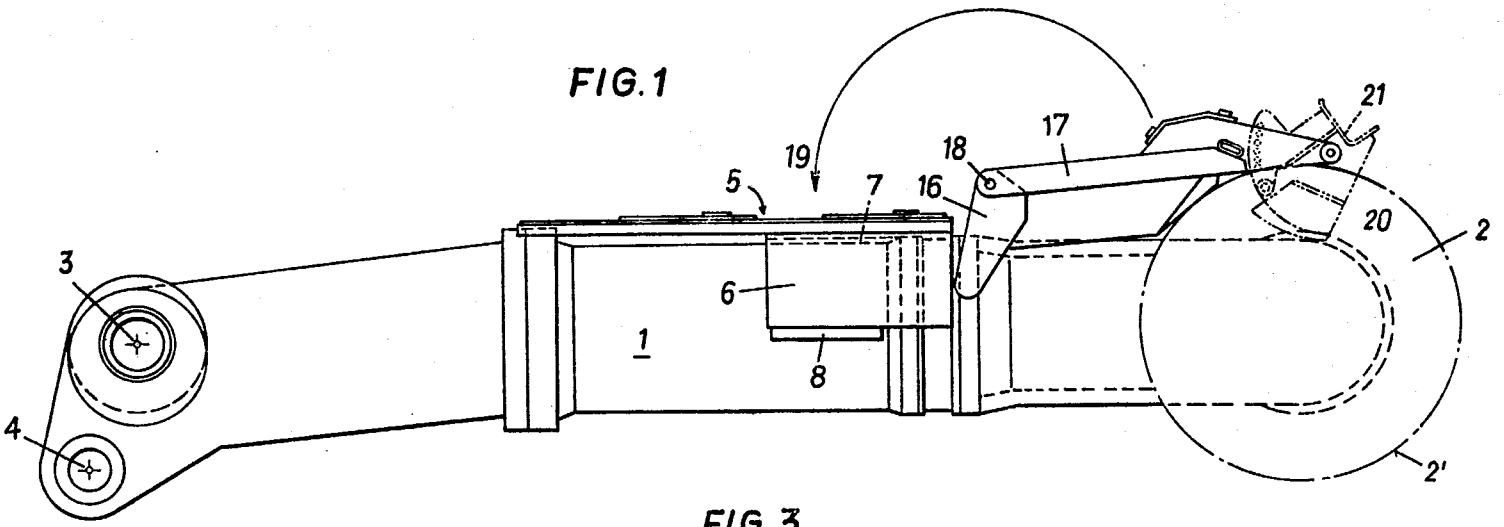

This invention relates to a cutting machine comprising a cutter arm, which is universally pivotally movable and carries at its free end a cutting tool. Such cutting machines are usually employed for driving tunnels in mines or as passageways. In the conventional cutting machines the cutter arm serves only as a carrier for the cutter head or heads and to accommodate the cutter head drive motor and the transmission associated therewith. The cutter arm is usually cylindrical in a major part of its length.

The invention resides essentially in that at least part of the cutter arm is covered by a walk-on platform. The invention thus provides a walk-on platform, which enables operators to work in regions which are not readily accessible from the floor, e.g. at the roof. In this way the cutting machine serves not only for cutting but also as a platform for operators. This is advantageous because a liftable platform cannot be used at the face where a cutting machine is in operation. Even if the time required to move back the cutting machine were tolerable, an additional difficulty remains which resides in that the cutting machine almost completely occupies the entire cross-section of the tunnel so that a liftable platform cannot be used between the cutting machine and the face. Another advantage afforded by the invention resides in that the cutter arm is substantially protected by the platform from damage by rock falling down. Besides, accessories must be mounted in many cases on the outside of the cutter arm. For instance, a guard for preventing a collision of the cutter arm with the loading ramp or the loading arms may be mounted on the cutter arm and may comprise hydraulic conduits and control valves. Moreover, conduits for water for cooling the cutting teeth of the cutter head must extend along the cutter arm on the outside thereof. All these accessories are protected by the platform. The platform is preferably box-shaped in cross-section and laterally protrudes from the cross-section of the cutter arm and has a bottom wall which conforms to the cross-section of the cutter arm. Such accessories may be disposed within the box and are thus protected on all sides, and the box-section body can easily be adapted to the cross-section of the cutter arm and facilitates the fixation of the platform to the cutter arm.

In a preferred embodiment of the invention, walk-on plates are hinged to the platform at both side edges thereof on axes which are approximately parallel to the axis of the cutter arm and said plates are pivotally movable from a position in which they lie on the platform to an extended position, in which they are approximately parallel to the platform. The platform does not interfere with the cutting operation, and in accordance with the invention the laterally extensible, hinged plates may be locked in position on the platform. During non-cutting intervals, the cutter arm can be adjusted to a straight, approximately horizontal position and the platform area can be enlarged in that the hinged plates are extended.

Also in accordance with the invention, a walk-on plate may be hinged to the cutter arm or platform at the front end of the latter on an axis which is transverse to the axis of the cutter arm and may be adapted to be swung back onto the platform and provided at its free end with a strut, which is adapted to be supported on the housing of the cutter arm. In that case the platform can be enlarged also at the forward end toward the face. The resulting platform cannot only be used for work at the roof but also facilitates the access to the cutter head for an inspection of the cutting teeth and for a replacement thereof in case of need. If cutter heads are mounted on opposite sides of the cutter arm for rotation on a horizontal axis, the strut may be adapted to be supported on the housing of the cutter arm between the cutter head. This design also affords the advantage that when the cutter arm is in operative position and the plate is swung back, the latter serves as a stone guard, which ensures a reliable protection of the driver against stones falling down, particularly when the cutting machine works to a high elevation.

Figure 3:
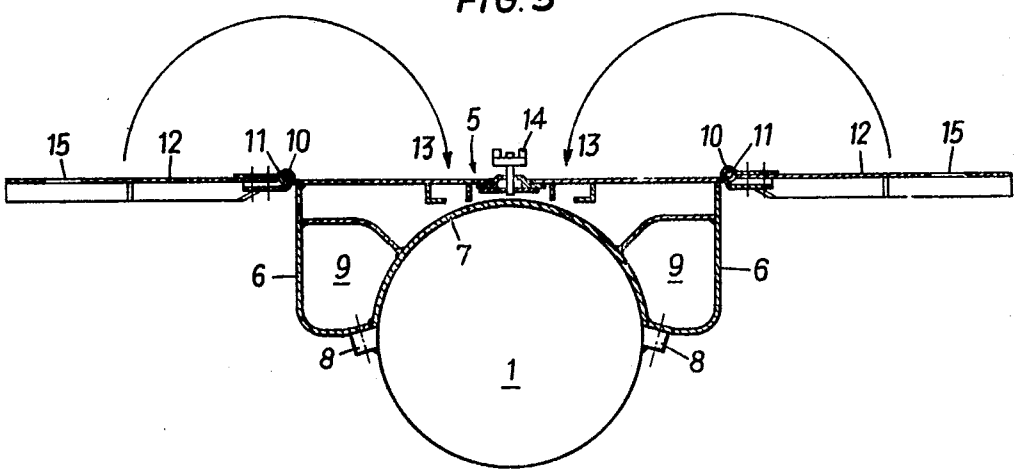
Figure 2:
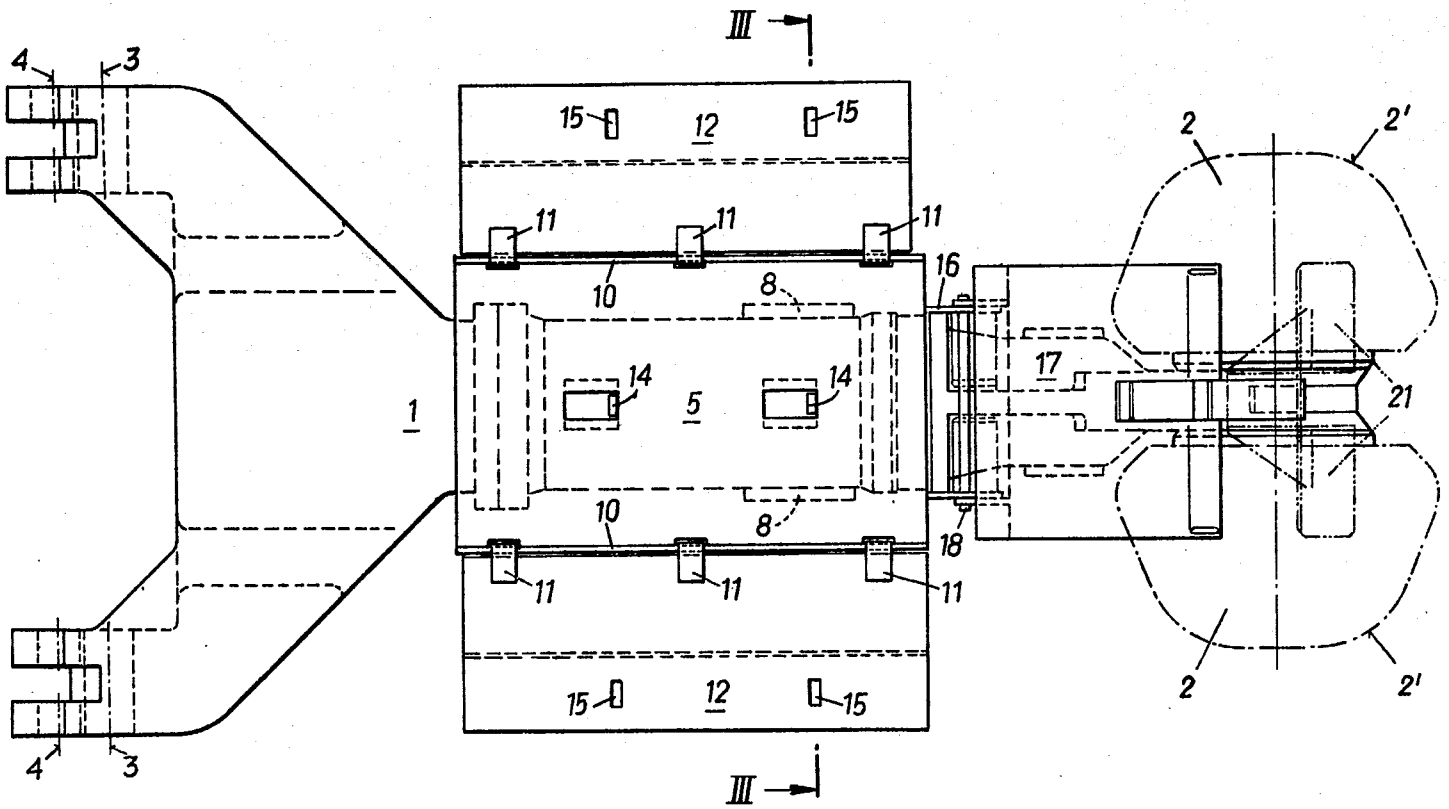

An embodiment of the invention is shown diagrammatically and by way of example on the drawing, in which a cutter arm and a platform are shown in FIG. 1 in a side elevation, in FIG. 2 in a top plan view and in FIG. 3 in a transverse sectional view taken on line III—III in FIG. 2.

Two cutter heads 2 are disposed laterally of a cutter arm 1. The flight circle 2' of the cutting teeth is indicated in phantom. The cutter arm 1 is pivoted to the swivel head of the cutting machine on a horizontal pivot 3. A hydraulic lifting gear for imparting a vertical pivotal movement to the cutter arm is connected to the latter at 4.

A platform 5 is mounted on the cutter arm 1 and comprises a box-section body 6. The bottom wall 7 of that body is cylindrical and conforms to the cylindrical cutter arm 1. The cutter arm 1 has lateral extensions 8, to which the box-section body of the platform 5 is connected by screws. Conduits and the like may extend in cavities 9 of the box-section body of the platform 5. The platform 5 protrudes from the cutter arm 1 on both sides.

At its edges, the platform 5 is provided with pins 10, which are parallel to the cutter arm 1. Plates 12 for enlarging the walk-on platform are connected to the pins 10 by hinges 11, which are so designed that the plates 12 are supported in a horizontal position. The plates 12 can be swung in the direction of arrows 13 onto the platform 5. Two catches 14 are pivoted to the platform 5 and are adapted to lock the plates 12 when they are swung in.

Brackets 16 are secured to the cutter arm 1 in front of the platform 5. A walk-on plate 17 is pivoted to said brackets on a pivot 18, which is transverse to the axis of the cutter arm 1. During a cutting operation, the plate 17 lies on the platform 5 and the swung-back plates 12 in a position to which it has been swung back in the direction of the arrow 19.

A strut 20 indicated in phantom may be provided on the free end of the plate 17 and when the latter has been swung out rests on the housing of the cutter arm 1 between the two cutter heads 2. The strut 20 is provided with a receptacle 21, in which roof caps can be placed, so that roof caps can be set in that the cutter arm is pivotally raised.

We claim:

1. In a cutting machine having a cutter arm which is mounted at one end for universal pivotal movement and which carries at its free end a cutting tool: a walk-on platform covering at least part of the cutter arm, said platform being box-shaped in cross-section and having a width greater than the width of the cutter arm so as to protrude beyond the sides of the cutter arm and said platform having a generally planar top wall and a bottom wall which conforms to and rests on the exterior surface of the cutter arm; and at least one walk-on plate hinged to the platform at a side edge thereof for swinging movement about an axis which is approximately parallel to the axis of the cutter arm, said plate having a width less than the width of the top wall of the platform movable from a position in which it lies on the top wall of the platform to an extended position in which it is approximately co-planar with the top wall of the platform.

2. A cutting machine as in claim 1 including means for locking the hinged walk-on plate in position on the top wall of the platform.

3. In a cutting machine having a cutter arm which is mounted at one end for universal pivotal movement and which carries at its free end a cutting tool: a walk-on platform covering at least part of the cutter arm, said platform being box-shaped in cross-section and having a width greater than the width of the cutter arm so as to protrude beyond the sides of the cutter arm and said platform having a generally planar top wall and a bottom wall which conforms to and rests on the exterior surface of the cutter arm; and at least one walk-on plate hinged to the platform at a side edge thereof for swinging movement about an axis which is approximately parallel to the axis of the cutter arm, said plate having a width less than the width of the top wall of the platform movable from a position in which it lies on the top wall of the platform to an extended position in which it is approximately co-planar with the top wall of the platform; and a further walk-on plate hinged to one of the cutter arm and platform at the front end of the latter on an axis which is transverse to the cutter arm so that said further plate can swing back onto the platform and a strut provided at the forward end of said further plate and adapted to engage the cutter arm to support said further plate, said cutting tool including two cutter heads mounted on opposite sides of the cutter arm and the point of engagement of the strut with the cutter arm being between the cutting heads.

4. A cutting machine as in claim 3 including means for locking the hinged walk-on plate in position on the top wall of the platform.

* * * * *